US006758075B1

(12) United States Patent
Thwing

(10) Patent No.: US 6,758,075 B1
(45) Date of Patent: Jul. 6, 2004

(54) CONVERSION BETWEEN LOCK FUNCTIONS USING LOCK ACTUATOR

(76) Inventor: Randy L. Thwing, 5001 Dorrell La., Las Vegas, NV (US) 89131

( * ) Notice: Subject to any disclaimer, the term of this patent is extended or adjusted under 35 U.S.C. 154(b) by 85 days.

(21) Appl. No.: 10/164,493

(22) Filed: Jun. 6, 2002

(51) Int. Cl.[7] ..... E05B 11/00
(52) U.S. Cl. ..... 70/389; 70/379 R; 70/372
(58) Field of Search ..... 70/31, 38 R, 38 A, 70/38 B, 38 C, 39, 372, 379 R, 380, 389

(56) References Cited

U.S. PATENT DOCUMENTS

| | | | | |
|---|---|---|---|---|
| 1,564,463 A | | 12/1925 | Best | |
| 1,636,381 A | | 7/1927 | Megie et al. | |
| 1,929,658 A | | 10/1933 | Solliday | 70/91 |
| 2,213,262 A | | 9/1940 | Sagel | 70/461 |
| 2,433,114 A | | 12/1947 | Gray | 70/367 |
| 2,460,615 A | | 2/1949 | Andrew | 70/369 |
| 3,143,872 A | | 8/1964 | Check | 70/38 |
| 3,172,279 A | | 3/1965 | Patriquin | 70/38 |
| 3,404,549 A | | 10/1968 | Best | 70/370 |
| 3,728,879 A | | 4/1973 | Best | 70/38 R |
| 3,788,111 A | | 1/1974 | Parlier | 70/379 R X |
| 3,793,856 A | | 2/1974 | Lippisch | 70/38 A |
| 3,882,699 A | | 5/1975 | Flack et al. | 70/38 A |
| 4,068,510 A | | 1/1978 | Neary | 70/379 R |
| 4,112,715 A | | 9/1978 | Uyeda | 70/38 A |
| 4,138,868 A | | 2/1979 | Richards, Sr. | 70/38 A |
| 4,228,669 A | * | 10/1980 | Bischoff | 70/379 R |
| 4,290,280 A | | 9/1981 | Yun | 70/38 A |
| 4,369,642 A | * | 1/1983 | Grell | 70/389 |
| 4,419,873 A | | 12/1983 | Sopko | 70/38 A |
| 4,576,026 A | | 3/1986 | Kurt et al. | 70/380 |
| 4,663,953 A | | 5/1987 | Fish et al. | 70/380 |
| 4,689,977 A | | 9/1987 | Wolniak et al. | 70/379 R |
| 4,763,496 A | | 8/1988 | Evans et al. | 70/38 A |
| 4,776,187 A | | 10/1988 | Evans et al. | 70/38 A |
| 4,793,166 A | | 12/1988 | Marks | 70/379 R |
| 4,926,670 A | | 5/1990 | Deforrest, Sr. | 70/380 X |
| 5,044,183 A | * | 9/1991 | Neyret | 70/379 R X |
| 5,174,136 A | | 12/1992 | Thwing | 70/38 A |
| 5,363,678 A | | 11/1994 | Meckbach | 70/38 A |
| 5,377,511 A | | 1/1995 | Meckbach | 70/38 A |
| 6,145,356 A | | 11/2000 | Thwing | 70/389 |
| 6,257,154 B1 | * | 7/2001 | Kasper | 70/379 R X |

OTHER PUBLICATIONS

Best Lock Corporation, Catalog Section 4, 1989 (p. 4.19). Two sheets of drawings Fig. 1–Fig. 7.
Technitips, Helpful Hints from Fellow Locksmiths, Oct. 6, 1992 (p. 9).
MasterLock Catalog pp. 7, 11–13 and 17–18 (undated).
Medeco Catalog Page, Product No. 51–510–XX, 1979.
Medeco Catalog Page, Product No. 51–500–XX, 1979.

* cited by examiner

*Primary Examiner*—Suzanne Lale Dino Barrett
(74) *Attorney, Agent, or Firm*—The Patent Source

(57) ABSTRACT

Methods, systems and apparatus for converting locks between key-retaining and non-key-retaining functions by means of a function-determinative lock actuator are disclosed. The disclosure teaches lock sub-assemblies that utilize a function-determinative actuator and a cooperating rotator bolt to transfer motion from a lock cylinder to a lock release mechanism. The function-determinative actuators can include movable portions that selectively determine the lock function by adjustment of the movable portion. Alternatively, changing the structure of, selectively adding portions to and/or removing portions from the actuator can determine the lock function. The disclosure also teaches dual-function locks that incorporate the above-noted lock sub-assemblies. Methods of converting lock functions using a function-determinative actuator are also disclosed.

25 Claims, 5 Drawing Sheets

CONVERSION BETWEEN LOCK FUNCTIONS USING LOCK ACTUATOR

BACKGROUND OF THE INVENTION

1. Field of the Invention

The present invention is directed to systems, methods, apparatus and related sub-assemblies for converting locks between key-retaining and non-key-retaining functions. More particularly, the invention relates to conversion of locks between key-retaining and non-key-retaining functions by means of a function-determinative lock actuator. Accordingly, the general objects of the invention are to provide novel systems, methods, apparatus and sub-assemblies of such character.

2. Description of the Related Art

Key operated locks are broadly classified into two mutually exclusive lock types. Locks of the first type are known as key-retaining locks because in such locks the lock mechanism prevents the key from being removed from the lock while the lock is in an unlocked condition. Locks of the second type are known as non-key-retaining locks because in such locks the lock mechanism permits the key to be removed from the lock while the lock is in an unlocked condition. Most conventional locks only offer one of these lock functions and, hence, are known as single-function locks.

One prior art single-function padlock 10 is shown in FIG. 1 and preferably comprises a padlock body 12, a lock cylinder 13 with a blade-like actuator 15 extending therefrom, at least one locking ball 16, a shackle 14 with a one or more recesses 17 for selectively receiving ball(s) 16, a rotational stop member 18 with an affixation screw and a rotator bolt 19. In particular, lock 10 of FIG. 1 is a key-retaining lock. As shown, padlock 10 is of a generally conventional configuration and employs locking ball(s) 16 (that cooperate with rotator bolt 19) that function as a release/locking mechanism to selectively release/retain shackle 14 in a locked or unlocked condition. A well-known variation of conventional lock cylinder 13, is the BEST-type (also known as the small format interchangeable-core) cylinder shown in FIG. 2. As depicted therein, cylinder 13' includes an end face 11 with a pair of apertures 11' for receiving corresponding legs of an actuator. A well-known variation of conventional rotator bolt 19, is depicted in FIG. 4. As shown therein, rotator bolt 19' includes a release-mechanism engaging portion 24 and an actuator-engaging end-portion 25 with wedge-shaped posts 27 and space therebetween.

Those of ordinary skill will readily appreciate that the particular configuration of the conventional lock/components noted-above can assume a wide variety of well-known and equivalent sizes and configurations. Thus, for example, padlock body 12, cylinders 13 and 13', actuator (or tailpiece) 15, shackle 14, ball(s) 16 and rotator bolts 19 and 19' can assume a wide variety of well-known and equivalent sizes and configurations. A mere sampling of such configurations of the related art is provided in the Information Disclosure Statement (with the associated Form PTO-1449) attached to this application. Further references to such conventional components should be understood to encompass these and other configurations known in the art.

There are practical, functional and security advantages to both key-retaining and non-key-retaining single-function locks. Since most manufacturers produce single-function locks discussed above, lock purchasers normally need to first determine which lock function meets their particular requirements, and then purchase the single-function lock of the appropriate type. Therefore, locksmiths and other lock suppliers are typically required to stock inventories of both key-retaining and non-key-retaining locks in order to satisfy the needs of all potential lock purchasers.

In order to eliminate the need for locksmiths and other lock suppliers to stock unnecessarily large inventories of both key-retaining locks and non-key-retaining locks, dual-function locks have been developed. Some exceptionally innovative dual-function padlocks are shown and described in U.S. Pat. No. 5,174,136 granted on Dec. 29, 1992 and entitled "Dual Function Padlock With Removable Cylinder Mechanism"; and in U.S. Pat. No. 6,145,356 granted on Nov. 14, 2000 and entitled "Dual-Function Locks And Sub-Assemblies Therefor"; which Patents are hereby incorporated by reference. Other highly similar dual-function padlocks are shown and described in U.S. Pat. No. 5,363,678.

U.S. Pat. No. 5,174,136 and U.S. Pat. No. 5,363,678 constitute examples of padlocks which can be readily converted between key-retaining and non-key-retaining functions by the introduction and/or disposal of components between the rotator bolt and the actuator of a lock cylinder. Thus, each of these locks offer the option of selecting one of two possible lock functions at the time of installation or later. However, in the case of each of these locks, components must be introduced into or removed from between the actuator and rotator bolt in order to achieve conversion of the lock function.

U.S. Pat. No. 6,145,356 represents an advance over the two aforementioned designs in that the locks shown and described therein can be readily converted between key-retaining and non-key-retaining functions without the introduction and/or disposal of components. The lock designs disclosed therein rely on either of at least two primary principles of operation. In the first, the rotator bolt of the lock is manipulated to achieve lock conversion (no change in the lock actuator is necessary for conversion to occur). This may occur, for example, by manipulation of and/or reorientation of a multi-component rotator bolt. In the second principle of operation, the rotator bolt and the actuator are reoriented relative to one another to achieve lock conversion. Thus, these locks also offer the ability to select the desired lock function at the time of installation or later. Neither of the aforementioned designs shown in U.S. Pat. No. 6,145,356, however, utilize manipulation and/or modification of the actuator structure to achieve lock conversion. It would be desirable to convert locks solely by manipulation and/or modification of the lock actuator because the actuator (along with the lock cylinder) is a readily accessible component of most locks. By contrast, lock rotator bolts are typically more difficult to access since they are often located deep within a cavity of the lock body.

There is, accordingly, a need in the art for novel methods, systems and apparatus that offer the ability to achieve inter-function conversion solely by manipulation and/or modification of a function-determinative lock actuator. Such methods and apparatus should enable a user to conveniently select the desired lock function without the use of additional components between the rotator bolt and the actuator. Additionally, such methods and apparatus should enable a user to conveniently select the desired lock function by manipulating/modifying a dual-function actuator thereby avoiding the need to access the rotator bolt deep within a cavity of the lock body.

SUMMARY OF THE INVENTION

The present invention satisfies the above-stated needs and overcomes the above-stated and other deficiencies of the related art by providing methods, systems and apparatus for converting locks between key-retaining and non-key-retaining functions by means of a function-determinative lock actuator. In one form, the invention can be a dual-function padlock capable of conversion between key-retaining and non-key-retaining lock functions. The inventive lock includes a number of conventional components such as a body, a shackle which is at least partially disposed within the padlock body, a shackle-release-mechanism for selectively releasing/retaining the shackle, and a rotatable cylinder at least partially mounted within the body. Additionally, the inventive lock includes an axis-defining rotator bolt, which is mounted within the padlock body for rotation about the axis, with a release-mechanism-engaging portion for controlling movement of the shackle-release-mechanism and an actuator-receiving portion. The inventive lock further includes a function-determinative actuator that rotates about the rotation axis in response to cylinder rotation, the actuator cooperating with the rotator bolt such that the lock can be converted between key-retaining and non-key-retaining functions by physically modifying the actuator.

The invention can also take the form of a dual-function lock sub-assembly for a lock of the type having a release-mechanism and an axis-defining lock-cylinder capable of transferring rotational motion to an actuator. In this form the invention includes a rotator bolt having a release-mechanism-engaging portion at one end thereof for controlling movement of the release-mechanism and an actuator-engaging portion for mechanically engaging at least a portion of the actuator. The invention also includes a dual-function actuator responsive to movement of the lock-cylinder for axial rotation therewith, the actuator having a free end extending from the cylinder, a first section which permits limited lost-motion between the free end of the actuator and the rotator bolt, and a second section for preventing lost-motion between the free end of the actuator and the rotator bolt. With this configuration, the lock function can be selectively determined by changing the second section of the actuator.

Still another form of the invention includes a method of converting a dual-function lock from a key-retaining mode to a non-key-retaining mode. The inventive method can be used with a lock of the type having a body, a rotatable lock cylinder at least partially mounted within the body and defining a rotation axis, a rotator bolt within the body for rotation about the axis, and an actuator extending from the cylinder and having a selective-engagement portion cooperating with the rotator bolt such that the actuator and the rotator bolt may remain generally stationary relative to one another. The inventive method comprises the steps of (a) taking the cylinder and actuator out of the lock body while leaving the rotator bolt within the body; (b) changing the selective-engagement portion of the actuator to thereby permit limited lost motion between the actuator and the rotator bolt when the cylinder and actuator are replaced into the body; and (c) replacing the cylinder and actuator into the body.

Naturally, the above-described methods of the invention are particularly well adapted for use with the above-described apparatus of the invention. Similarly, the apparatus of the invention are well suited to perform the inventive methods described above.

Numerous other advantages and features of the present invention will become apparent to those of ordinary skill in the art from the following detailed description of the preferred embodiments, from the claims and from the accompanying drawings.

BRIEF DESCRIPTION OF THE DRAWINGS

The preferred embodiments of the present invention will be described below with reference to the accompanying drawings where like numerals represent like steps and/or structures and wherein.

DETAILED DESCRIPTION OF THE PREFERRED EMBODIMENTS

Dual-function locks, and lock sub-assemblies therefor, in accordance with the preferred embodiments of the present invention will be described with joint reference to the Figures. Throughout this description, however, it is to be understood that, to facilitate understanding of the drawings, only enough structure of the apparatus has been illustrated to enable one skilled in the art to readily understand the underlying principles and concepts of the invention. Additionally, the present invention (although mostly illustrated herein in the context of padlocks) enjoys applicability in any lock that employs a rotatable cylinder, a lock release mechanism and structure for controlling the release mechanism in response to rotation of the cylinder. Such locks include padlocks, door locks and all other types of locks and security devices.

Figure 1:
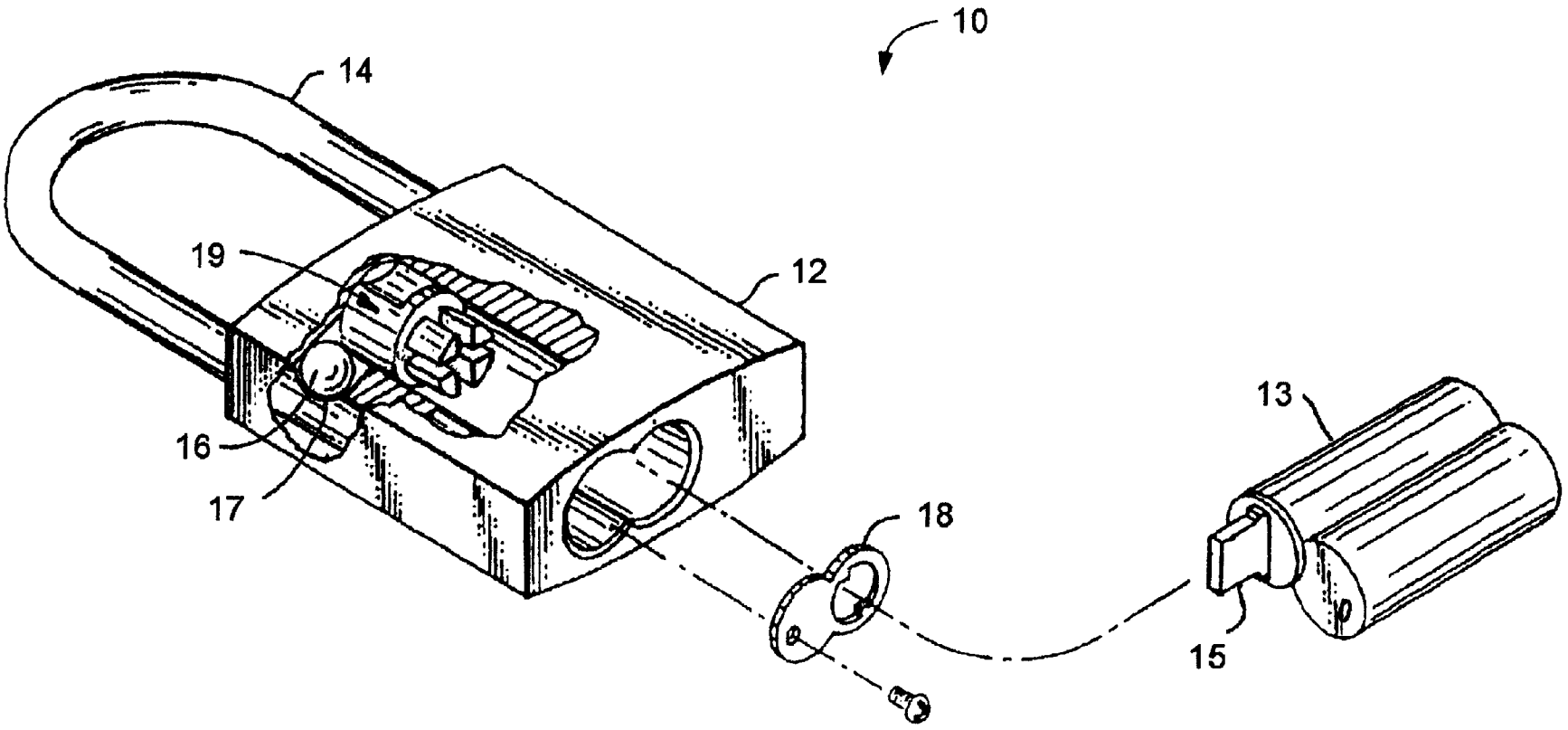
Prior Art Figure 1
FIG. 1 is an exploded and partially cut-away perspective illustration of a conventional single-function padlock of the prior art.
Figure 3B:
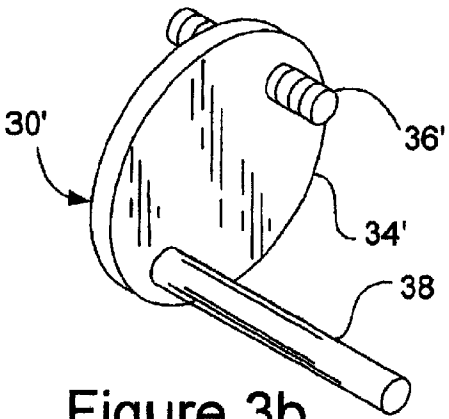
FIG. 3*b* shows a function-determinative actuator in accordance with another preferred embodiment of the present invention.
Figure 2:
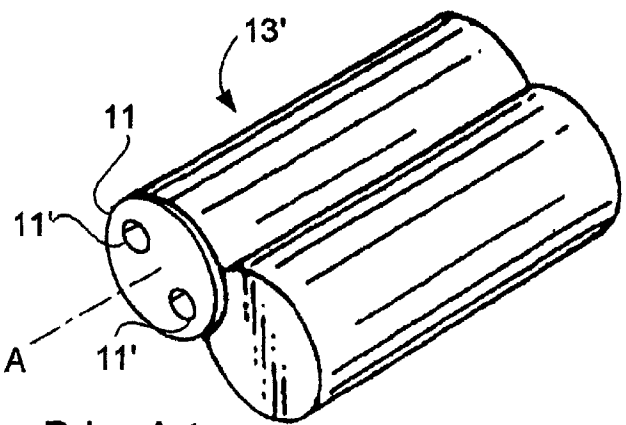
Prior Art Figure 2
FIG. 2 illustrates a BEST-type lock cylinder of the prior art.
Figure 3A:
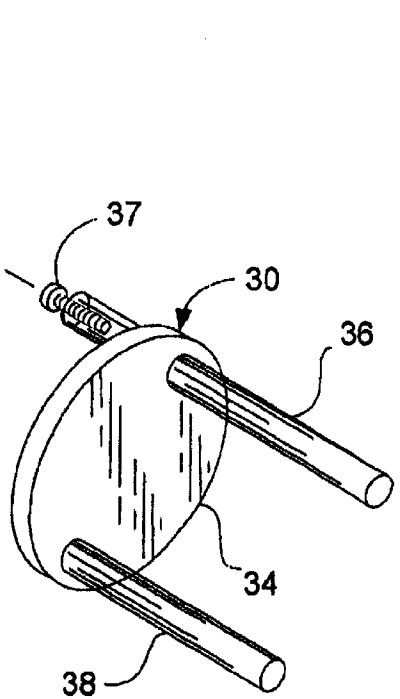
FIG. 3*a* shows dual-function lock sub-assembly in accordance with one preferred embodiment of the present invention.
Figure 3A:
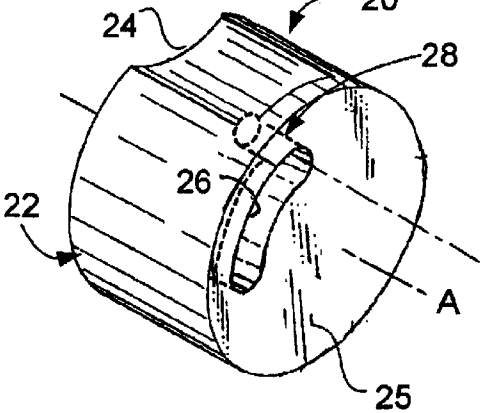
Figure 3C:
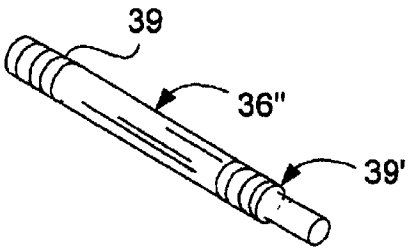
FIG. 3*c* shows a reversible tenon pin for use in a function-determinative actuator in accordance with some embodiments of the present invention.
Figure 5B:
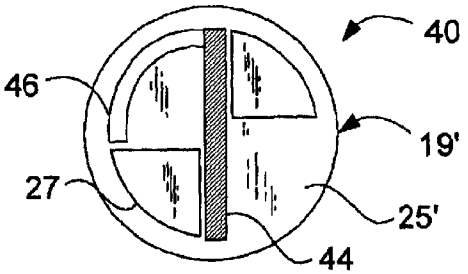
FIG. 5*b* depicts the actuator of FIG. 5*a* in operative engagement with the rotator bolt of FIG. 4.

With joint reference now to FIGS. 3*a*–3*c* there is shown a number of preferred dual-function lock sub-assemblies and actuators in accordance with the present invention. The sub-assemblies and components shown in FIGS. 3*a*–3*c* are particularly well suited for use with the conventional lock cylinder of FIG. 2. Additionally, these sub-assemblies (together with cylinder 13' of FIG. 2) are well suited for use in locks of the general type shown in FIG. 1.

With primary reference now to FIG. 3*a*, there is shown therein an inventive subassembly 20 that includes a rotator bolt 22 and an actuator 30. Rotator bolt 22 preferably defines an axis A and includes a release-mechanism-engaging portion 24 at one end thereof and an actuator-engaging portion 25 at an opposite end thereof. Rotator bolt 22 is designed for rotation about axis A in response to rotational motion initiated by cylinder 13' and transferred to rotator bolt 22 via actuator 30. Rotator bolt 22 preferably includes a radially-offset and arcuate slot having a lost-motion region 26 and an anchoring recess 28 at one end thereof.

Also shown in FIG. 3*a* is an actuator 30 in accordance with one preferred embodiment of the present invention. As shown, actuator 30 preferably includes a substantially circular plate 34 with tailpiece legs 36 and 38 affixed thereto. In use, actuator 30 is partially received within conventional cylinder 13' such that legs 38 and 36 extend into apertures 11' of cylinder 13' and permit the free end of leg 36 to be received within slot 26. The free end of leg 36 also preferably includes a movable member 37 which, in this embodiment, takes the form of a threaded screw that can be adjusted to reduce or increase the distance that leg 36 extends beyond the lock cylinder. When movable member 37 is in a retracted position (to thereby shorten the length of leg 36), it is received within lost-motion recess 26 such that limited lost motion is permitted to occur between rotator bolt 22 and actuator 30. Hence, in the retracted position, no part of movable member 37 is in anchoring recess 28. When movable member 37 is placed in an extended position, at least a portion of it will be trapped within anchoring recess 28 so that rotator bolt 22 remains generally stationary relative to actuator 30. By moving member 37 between the retracted and extended positions, sub-assembly 20 can be used to selectively convert the lock function between non-key-retaining and key-retaining modes respectively. In a variation of this embodiment the threaded member 37 takes the form of a set-screw extending through the side of plate 34 in order to selectively secure a longitudinally movable leg 36 at the desired distance beyond plate 34.

Turning now to FIG. 3*b*, this figure shows a function-determinative actuator 30' in accordance with another preferred embodiment of the present invention and can be used as an alternative to function-determinative actuator 30 in sub-assembly 20. While actuator 30' is substantially similar to, and operates in the same general manner as, actuator 30, there are a number of differences between these actuators. First, actuator 30' includes a threaded member 36' in lieu of leg 36 (which is preferably snugly fit into plate 34) of actuator 30. Second, plate 34' includes a threaded aperture to receive threaded member 36' such that threaded member 36' may be adjusted to selectively determine the function (key-retaining or non-key-retaining) specified by actuator 30'. In particular, with threaded member 36' adjusted to a retracted position in which no part of the threaded member extends into anchoring recess 28, lost-motion may occur and a non-key-retaining function is specified. With threaded member 36' adjusted to an extended position wherein at least a portion of member 36' extends into and is trapped by anchoring recess 28, a key-retaining function is specified. Naturally, as with the embodiment of FIG. 3*a*, the desired lock function can be repeatedly selected and unselected without adding or taking away lock components.

FIG. 3*c* shows a reversible tenon pin 36" for use in a function-determinative actuator in accordance with yet another preferred embodiment of the present invention. In particular, an actuator utilizing reversible tenon pin 36" is substantially similar to, and operates in the same general manner as, actuator 30', there are a number of differences between these actuators. First, reversible tenon pin 36" is generally designed to substitute for threaded member 36' in actuator 30'. Pin 36" preferably includes a threaded first end 39 at one end thereof and an opposite end 39' having both a threaded region and a non-threaded tenon extending therefrom. In a retracted position, threaded first end 39 of tenon pin 36" is threaded into plate 34' such that the end thereof does not extend substantially beyond plate 34'. In an extended position, the opposite end 39' is threaded into plate 34' such that the non-threaded tenon extends into and is trapped by anchoring recess 28 of rotator bolt 22. By longitudinally reversing tenon pin 36" in this way, actuator 30' can be configured to determine the desired lock function. Alternatively, actuator 30' can be configured to determine the desired lock function by breaking off the tenon of tenon pin 36" to thereby change the distance by which pin 36" extends beyond plate 34'.

Only a few simple steps are necessary to change the lock function of a dual-function lock using the inventive lock sub-assemblies described above and throughout the remainder of this specification. In particular, a user merely needs to take the cylinder 13 and actuator (e.g., 30) out of the lock body 12 while leaving the rotator bolt (e.g., 22) within the body. Then the dual-function actuator is changed such that limited lost-motion may occur between the actuator and the rotator bolt when the cylinder and actuator are replaced into the body. Finally, the cylinder and the (now modified) actuator are replaced into the lock body. While other steps can be added to this procedure, the three steps listed above are all that is necessary.

A number of variations of the lock sub-assemblies described above are within the skill of the ordinary artisan based on the disclosure contained herein. For example, while each of actuator 30 and 30' are shown as having two legs that can be received within apertures 11' of cylinder 13', only one leg is necessary for functionality. Additionally, the inventive concepts represented by the embodiments of FIGS. 3*a*–3*c* can be readily adapted to any of the many well-known lock cylinders that will readily occur to those one or skilled in the art. Thus, the size, structure and configuration of legs 36 and 38 may be readily adapted for use with any given companion lock cylinder desired. Alternatively, legless actuator structures may be utilized with any given lock cylinder as appropriate.

Figure 4:
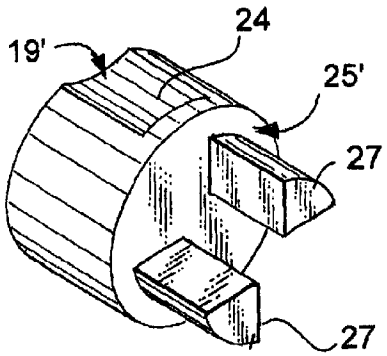
Prior Art Figure 4
FIG. 4 depicts a conventional rotator bolt of the prior art.

With joint reference now to FIGS. 5*a*–6*b* there is shown a number of other preferred dual-function lock subassemblies and actuators in accordance with the present invention. The sub-assemblies and components shown in FIGS. 5*a*–6*b* are particularly well suited for use with the conventional rotator bolt 19' of FIG. 4 and in locks of the general type shown in FIG. 1. With primary reference now to FIGS. 5*a* and 5*b*, there is shown therein an inventive lock sub-assembly that includes function-determinative actuator 42 and rotator bolt 19'. Actuator 42 preferably includes a generally blade-shaped portion 44 with a selective-engagement tab 46 extending laterally therefrom. In a particularly preferred embodiment, tab 46 is connected to portion 44 with a break-joint to assist in clean removal of tab 46 from actuator portion 44. With selective-engagement tab 46 connected to actuator portion 44 as shown herein, actuator 42 is trapped between posts 27 in an actuator engaging portion 25' of rotator bolt 19' such that actuator 42 remains generally stationary relative to rotator bolt 19'. Hence, this configuration yields a key-retaining lock. Lock sub-assembly 40 can be selectively converted into a non-key-retaining mode by removal of tab 46 at the break-joint to thereby permit limited lost-motion between actuator 42 and rotator bolt 19'.

Figure 6B:
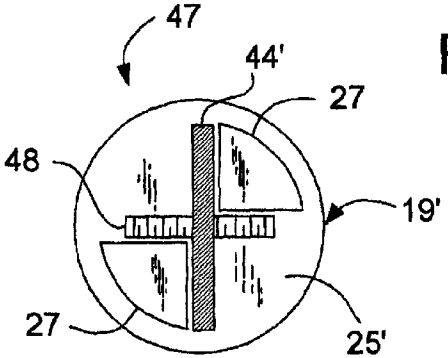
FIG. 6*b* depicts the actuator of FIG. 6*a* in operative engagement with the rotator bolt of FIG. 4.
Figure 6C:
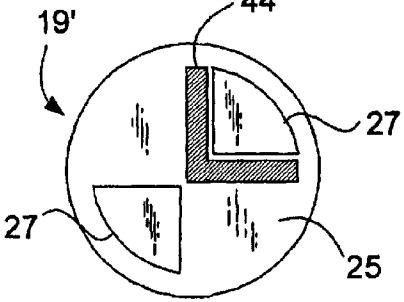
FIG. 6*c* depicts a variant of the sub-assemblies of FIGS. 5 and 6 in which the actuator has been bent to select the lock function.
Figure 5A:
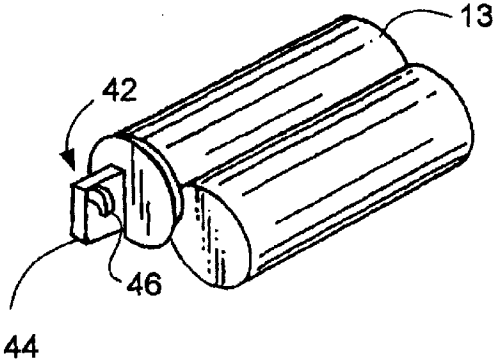
FIG. 5*a* shows a conventional lock cylinder with a function-determinative actuator, in accordance with one preferred embodiment of the present invention, extending therefrom.
Figure 6A:
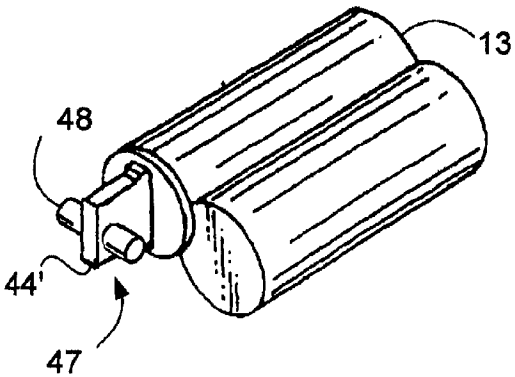
FIG. 6*a* shows the conventional lock cylinder of FIG. 5*a* with a function-determinative actuator, in accordance with another preferred embodiment of the present invention, extending therefrom.

Turning primarily to FIGS. 6*a* and 6*b*, there is shown therein an alternative variation of the dual-function lock sub-assembly described above with respect to FIGS. 5*a* and 5*b*. This embodiment of the present invention includes an actuator 47 with a blade-like actuator member 44' and another member 48 extending generally transverse thereto. As shown in FIG. 6*a* and FIG. 6*b*, transverse member 48 can be a pin press it into an aperture of blade-like member 44'. Alternatively, member 48 can be a screw which is threadedly received within a threaded aperture of blade-like member 44'. Additionally, if member 48 is of sufficient length, it will be trapped within the lock. Thus, member 48 does not need to be press fit within blade like member 44' since it may ride loosely within the rotator bolt. With transverse member 48 connected to actuator portion 44 as shown herein, actuator 47 is trapped between posts 27 in an actuator-engaging portion 25' of rotator bolt 19' such that actuator 47 remains stationary relative to rotator bolt 19'. Lock sub-assembly 40 can, thus, be configured for a key-retaining mode. Sub-assembly 40 can be selectively converted into a non-key-retaining mode by removal of member 48 to thereby permit limited lost-motion between actuator 47 and rotator bolt 19'.

In one variation of the embodiments of FIGS. 5 and 6, a portion of blade-like actuator 44" can be bent to one side (e.g., by about 90 degrees) such that one of posts 27 is captured on two sides thereof (see FIG. 6*c*). By bending the actuator in this way, the sub-assembly can be converted from a non-key-retaining function to a key-retaining function and back again.

Figure 7A:
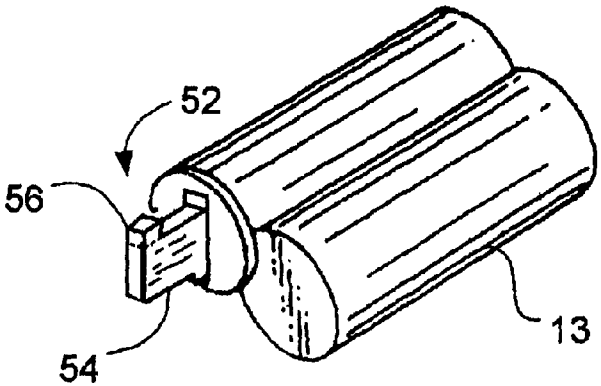
FIG. 7*a* shows the conventional lock cylinder of FIG. 5*a* with a function-determinative actuator, in accordance with another preferred embodiment of the present invention, extending therefrom.
Figure 7D:
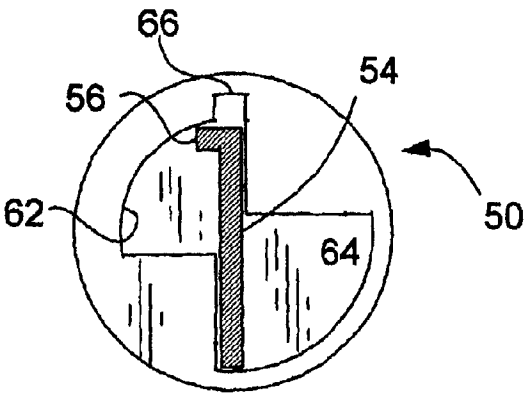
FIG. 7*d* depicts variant of the lock sub-assembly of FIG. 7*c* in which the actuator of FIG. 7*a* has been bent to select the lock function.
Figure 7B:
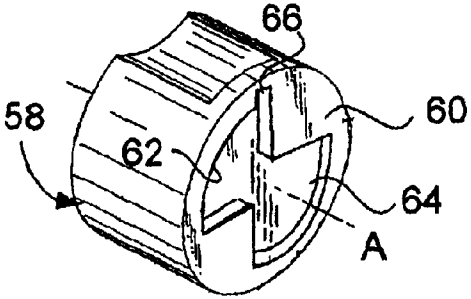
FIG. 7*b* shows an inventive rotator bolt for use in a lock sub-assembly in accordance with another preferred embodiment of the present invention.
Figure 7C:
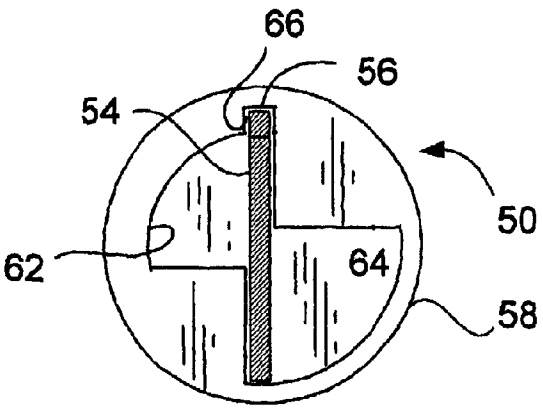
FIG. 7*c* depicts another inventive lock sub-assembly, the sub-assembly being shown with the actuator of FIG. 7*a* in operative engagement with the inventive rotator bolt of FIG. 7*b;*

With joint reference now to FIGS. 7*a*–7*c* there is shown a number of preferred dual-function lock sub-assemblies and actuators in accordance with still another embodiment of the present invention. The subassemblies and components shown in FIGS. 7*a*–7*c* are particularly well suited for use with the conventional lock cylinder 13 of FIG. 1. Additionally, these sub-assemblies (together with cylinder 13 of FIG. 1) are well suited for use in locks of the general type shown in FIG. 1.

With continuing joint reference to FIGS. 7*a*–7*c*, there is shown therein an inventive sub-assembly 50 that includes an inventive rotator bolt 58 and an inventive actuator 54. Rotator bolt 58 preferably defines an axis A and includes a release-mechanism engaging portion at one end thereof and an actuator-engaging recess 62 at an opposite end thereof. Rotator bolt 58 is designed for rotation about axis A in response to rotational motion initiated by cylinder 13 and transferred to rotator bolt 58 via actuator 52. As shown, one end of rotator bolt 58 preferably includes at least one recess, with both a lost-motion region 64 and an anchoring region 66, for receiving actuator 52.

Function-determinative actuator 52 in accordance with another preferred embodiment of the present invention is shown in perspective view in FIG. 7*a*. As shown, actuator 52 preferably includes a generally blade-shaped portion 54 with a removable tab 56 extending therefrom and a junction (such as a break-joint) therebetween. In use, function-determinative actuator 52 is partially received within conventional cylinder 13 such that the free end of actuator 52 extends away from cylinder 13 and may be received within actuator-engaging recess 62. When removable member 56 is trapped within anchoring recess 66 of recess 62, rotator bolt 58 remains generally stationary relative to actuator 52 and the key-retaining function is selected. When removable member 56 is removed from actuator 52, no portion of the actuator is received within anchoring recess 66 and limited lost-motion is permitted to occur between rotator bolt 58 and actuator 52. In this state, the non-key-retaining function is selected. Thus, by removing portion 56 from actuator 52, sub-assembly 50 can be used to convert the lock function from the key-retaining mode to the non-key-retaining mode. As shown in FIG. 7*d*, one alternative to changing the lock function by removing tab 56 altogether is to bend tab 56 to one side until it can no longer reach anchoring recess 66. Tab 56 could also be bent back to the original position to again select the key-retaining function. Those of ordinary skill will recognize other variations in light of the disclosure contained herein.

Figure 8B:
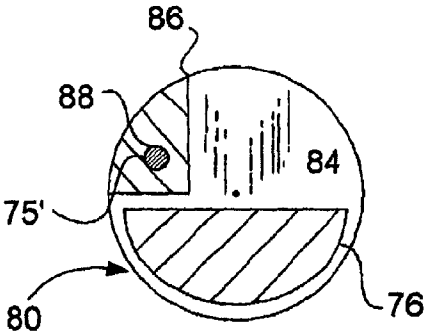
FIG. 8*b* depicts the inventive lock sub-assembly of FIG. 8*a*, the sub-assembly being shown in cross-section with the actuator being in operative engagement with the inventive rotator bolt.
Figure 8C:
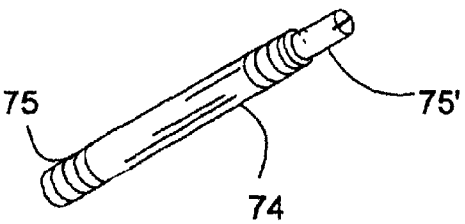
FIG. 8*c* shows a reversible tenon pin for use in the function-determinative actuator in accordance with the embodiment FIGS. 8*a* and 8*b*.
Figure 8A:
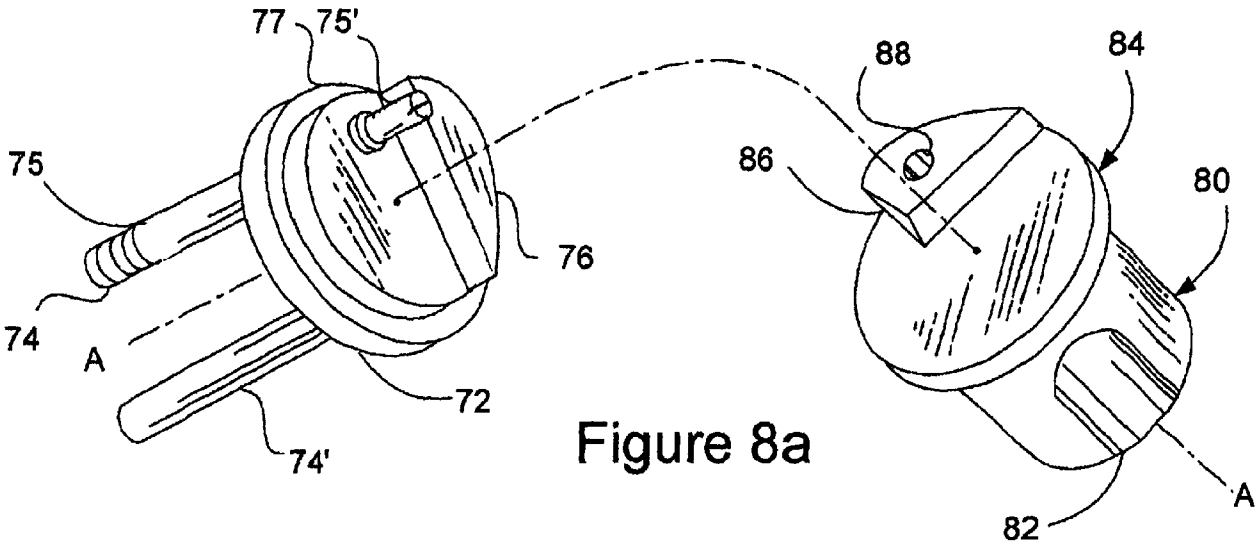
FIG. 8*a* depicts another inventive lock sub-assembly with an inventive actuator in operative engagement with an inventive rotator bolt.

Another preferred dual-function lock sub-assembly in accordance with the present invention is illustrated in FIGS. 8*a*–8*c*. As shown therein, sub-assembly 70 preferably includes a function-determinative actuator 72 with a substantially circular plate 77, with reversible tenon pin 74 (see especially FIG. 8*c*) with a fixed actuator leg 74' and with a raised lost-motion driver region 76. Sub-assembly 70 also includes a rotator bolt 80 which defines an axis A and includes a release-mechanism-engaging portion 82 and an actuator-engaging portion 84 at an opposite end thereof. Rotator bolt 80 is designed for rotation about axis A in response to rotational motion initiated by a conventional cylinder 13' (e.g., cylinder 13' of FIG. 4) and transferred to rotator bolt 80 via actuator 72. Rotator bolt 80 preferably includes a lost-motion region 86 and radially-offset anchoring recess 88 at actuator-engaging portion 84.

In use, dual-function actuator 70 is partially received within a cylinder such that pin 74 and leg 74' extend into apertures of the cylinder. Plate 77 includes a threaded aperture to receive threaded portions 75 and 75' of tenon pin 74 such that one or the other of the threaded ends may be threadedy secured to selectively determine the function (key-retaining or non-key-retaining). In particular, with tenon pin 74 oriented in the extended position shown in FIG. 8*a*, wherein at least a portion of end 75' extends into and is trapped by anchoring recess 88 of rotator bolt 80, a key-retaining function is specified (see especially FIG. 8*b*). With tenon pin 74 longitudinally reversed into the retracted position in which threaded end 75 is received in the threaded aperture of plate 77, but no part of threaded end 75 extends into anchoring recess 88, lost-motion may occur and a non-key-retaining function is specified. By longitudinally reversing tenon pin 74 in this way, actuator 72 can be configured to determine the desired lock function and the desired lock function can be repeatedly selected and unselected without adding or taking away lock components. In one variation of this embodiment, tenon pin 74 is snugly fit, but nonetheless longitudinally movable, within an aperture of plate 77 in lieu of utilizing threaded regions.

In an alternative variation, tenon pin 74 is a movable member that includes an elongated threaded region at free end 75' (instead of the tenon shown in FIGS. 8*a* and 8*c*) that can be adjusted to reduce or increase the distance that tenon 75' extends beyond the surface of plate 77 (the threads of end 75 are optional in this embodiment). When this variant movable member is in a retracted position (wherein end 75' is substantially flush with the surface of plate 77), lost-motion driver region 76 cooperates with rotator bolt 80 such that limited lost-motion is permitted to occur between rotator bolt 80 and actuator 72. Hence, in the retracted position, no part of the variant movable member is in anchoring recess 88 of rotator bolt 80. When the movable member is placed in an extended position, at least a portion of it will extend substantially beyond the surface of plate 77 and be trapped within anchoring recess 88 so that rotator bolt 80 remains generally stationary relative to actuator 72 (see especially FIG. 8*b*). Thus, by moving the variant movable member between the retracted and extended positions, sub-assembly 70 can be used to selectively (and repeatedly) convert the lock function between non-key-retaining and key-retaining modes respectively. In another variation of this alternative embodiment, the movable member is threaded along the entire length thereof. In a variation of this embodiment a threaded member may be used as a set-screw extending through the side of plate 77 in order to selectively secure a longitudinally movable leg (tenon pin 74 or some variation thereof) at the desired distance beyond plate 77.

While the present invention has been described in connection with what is presently considered to be the most practical and preferred embodiments, it is to be understood that the invention is not limited to the disclosed embodiments, but is intended to encompass the various modifications and equivalent arrangements included within the spirit and scope of the appended claims. With respect to the above description, for example, it is to be realized that the optimum dimensional relationships for the parts of the invention, including variations in size, materials, shape, form, function and manner of operation, assembly and use, are deemed readily apparent to one skilled in the art, and all equivalent relationships to those illustrated in the drawings and described in the specification are intended to be encompassed by the appended claims. Therefore, the foregoing is considered to be an illustrative, not exhaustive, description of the principles of the present invention.

What is claimed is:

1. A dual-function lock sub-assembly for use with locks of the type having a rotatable lock cylinder and a release mechanism for unlocking the lock, the sub-assembly comprising:

an axis-defining rotator bolt with an actuator-engaging portion and a release-mechanism-engaging portion for controlling movement of the release-mechanism, wherein the actuator-engaging portion includes an anchoring recess that is radially offset from the rotation axis and that may receive part of an actuator; and a dual-function actuator connecting the cylinder and the actuator-engaging portion of the rotator bolt, the actuator rotating the rotator bolt in response to cylinder rotation and having a fixed portion and a selectively movable portion, the movable portion being movable between an extended position, wherein the movable portion is at least partially received in the anchoring recess, and a retracted position, wherein no part of the movable portion is received in the anchoring recess.

2. The dual-function lock sub-assembly of claim 1, wherein the actuator and the rotator bolt remain generally stationary relative to one another when the movable portion is in the extended position; and limited lost-motion may occur between the actuator and the rotator bolt when the movable portion is in the retracted position.

3. The dual-function lock sub-assembly of claim 1, wherein the movable portion of the actuator may be repeatedly moved from the extended position to the retracted position and back again.

4. The dual-function lock sub-assembly of claim 2, wherein the movable portion is a tenon pin;

the fixed portion of the actuator is a lost-motion region; and the actuator-engaging portion of the rotator bolt further comprises a fixed lost-motion region that cooperates with the lost-motion region of the actuator to permit limited lost-motion between the actuator and the rotator bolt when no part or the movable portion is received in the anchoring recess.

5. The dual-function lock sub-assembly of claim 4, wherein movement of the movable portion comprises longitudinally reversing the movable portion of the actuator.

6. The dual-function lock sub-assembly of claim 1, wherein moving the movable portion from the extended position to the retracted position consists of reducing the distance that the movable portion extends from the cylinder.

7. The dual-function lock sub-assembly of claim 1, wherein moving the movable portion from the extended position to the retracted position consist of screwing the movable portion toward the cylinder.

8. The dual-function lock sub-assembly of claim 1, wherein the actuator-engaging portion of the rotator bolt further comprises an arcuate slot the terminates at the anchoring recess.

9. A dual-function padlock capable of conversion between key-retaining and non-key-retaining lock functions comprising:

a body;

a shackle which is at least partially within the padlock body, a shackle-release-mechanism for selectively releasing/retaining the shackle;

a rotatable cylinder at least partially within the body;

an axis-defining rotator bolt within the padlock body for rotation about the axis, the rotator bolt including a release-mechanism-engaging portion for controlling movement of the shackle-release-mechanism, the rotator bolt also including an actuator-receiving portion; and a function-determinative actuator which rotates about the rotation axis in response to cylinder rotation, the actuator cooperating with the rotator bolt such that the lock can be converted between key-retaining and non-key-retaining functions by physically modifying the actuator.

10. The dual-function lock of claim 9, wherein the lock can be converted between key-retaining and non-key-retaining functions without changing the number of components in the lock.

11. The dual-function lock of claim 9, wherein the actuator-receiving portion of the rotator bolt includes a lost-motion section and an anchoring section;

the actuator comprising a movable portion which is movable between an extended position, wherein the movable portion is at least partially trapped in the anchoring section of the rotator bolt, and a retracted position, wherein the movable portion is not trapped in the anchoring section of the rotator bolt.

12. The dual-function lock of claim 11, wherein movement of the movable portion occurs by longitudinally reversing the movable portion of the actuator.

13. A lock sub-assembly for use in a lock of the type having a release-mechanism and a rotatable cylinder, the sub-assembly comprising:

a rotator bolt defining a rotation axis and being rotatable about the axis, the rotator bolt having means for receiving rotational motion and means for engaging the release-mechanism; and means, between the cylinder and the means for receiving rotational motion, for rotating the rotator bolt in response to rotation of the cylinder, the means for rotating being convertible between a key-retaining mode wherein the means for rotating and the rotator bolt are generally stationary relative to one another and a non-key-retaining mode wherein limited lost-motion may occur between the means for rotating and the rotator bolt.

14. The dual-function lock sub-assembly of claim 13, wherein the means for receiving rotational motion comprises an anchoring recess;

the means for rotating comprises a fixed portion and a movable portion which can be changed between an extended position wherein the movable portion is at least partially received in the anchoring recess, and a retracted position wherein no part of the movable portion is received in the anchoring recess.

15. The dual-function lock sub-assembly of claim 13, wherein the means for rotating comprises:

a generally blade-shape member with an aperture extending substantially transverse to the direction of axial rotation; and a rigid member that extends through the transverse aperture.

16. A dual-function lock sub-assembly for a lock of the type having a release-mechanism and a cylinder which is capable of transferring rotational motion to an actuator, the sub assembly comprising:

an axis-defining rotator bolt having a release-mechanism-engaging portion at one end thereof for controlling movement of the release-mechanism and an actuator-engaging portion for mechanically engaging at least a portion of an actuator; and a dual-function actuator responsive to movement of the lock-cylinder for axial rotation therewith, the actuator having a free end extending from the cylinder, the actuator having a first section which permits limited lost-motion between the free end of the actuator and the rotator bolt, the actuator also having a second section for preventing lost-motion between the free end of the actuator and the rotator bolt, wherein the lock function is selectively determined by physically modifying the second section of the actuator.

17. The dual-function lock sub-assembly of claim 16, wherein the actuator-engaging portion of the rotator bolt includes an anchoring recess;

the first section of the actuator comprises a fixed portion; and the second section of the actuator can be changed between an extended position wherein the second section is at least partially received in the anchoring recess, and a retracted position wherein no part of the second section is received in the anchoring recess.

18. The dual-function lock sub-assembly of claim 16, wherein the first section of the actuator is a generally blade-shaped member with an aperture extending substantially transverse to the direction of axial rotation; and the second section of the actuator comprises a rigid member that extends through the aperture.

19. The dual-function lock sub-assembly of claim 16, wherein the lock function is selectively determined by removing or replacing the second section of the actuator.

20. A method of converting a dual-function lock from a key-retaining mode to a non-key-retaining mode, the lock having a body, a rotatable lock cylinder at least partially within the body, an axis-defining rotator bolt within the body for rotation about the axis, and a dual-function actuator extending from the cylinder and having a selective-engagement portion that is operatively associated with the rotator bolt when the lock is in an assembled condition, the method comprising:

taking the cylinder and actuator out or the lock body while leaving the rotator bolt within the body;

changing the selective-engagement portion of the actuator to thereby permit limited lost-motion between the actuator and the rotator bolt when the cylinder and actuator are replaced into the body; and replacing the cylinder and actuator into the body.

21. The method of claim 20 wherein changing the actuator consists of reducing the distance that the selective-engagement portion extends from the cylinder.

22. The method of claim 20 wherein changing the actuator comprises bending the selective-engagement portion such that the actuator and the rotator bolt may rotate relative to one another.

23. The method of claim 20 wherein reducing the distance that the selective-engagement portion extends from the cylinder consists of screwing the selective-engagement portion into the cylinder.

24. The method of claim 23 wherein reducing the distance that the selective-engagement portion extends from the cylinder consists of eliminating at least some of the selective-engagement portion.

25. The method of claim 23 wherein reducing the distance that the selective-engagement portion extends from the cylinder comprises longitudinally reversing the selective-engagement portion.

* * * * *